US006648809B1

(12) United States Patent
Mackel et al.

(10) Patent No.: US 6,648,809 B1
(45) Date of Patent: Nov. 18, 2003

(54) CENTRIFUGE HAVING A GASEOUS MEDIUM AS A CONTROL FLUID AND METHOD OF OPERATING

(75) Inventors: Wilfried Mackel, Oelde (DE); Willi Niemerg, Oelde (DE); Thomas Kleimann, Oelde (DE)

(73) Assignee: Westfalia Separator AG, Oelde (DE)

( * ) Notice: Subject to any disclaimer, the term of this patent is extended or adjusted under 35 U.S.C. 154(b) by 0 days.

(21) Appl. No.: 09/959,686

(22) PCT Filed: Feb. 26, 2000

(86) PCT No.: PCT/EP00/01606

§ 371 (c)(1),
(2), (4) Date: Nov. 5, 2001

(87) PCT Pub. No.: WO00/69566

PCT Pub. Date: Nov. 23, 2000

(30) Foreign Application Priority Data

May 14, 1999 (DE) ..... 199 22 236

(51) Int. Cl.[7] ..... B04B 1/14
(52) U.S. Cl. ..... 494/26; 494/27
(58) Field of Search ..... 494/2–4, 23, 25–27, 494/48, 56, 62, 68–70

(56) References Cited

U.S. PATENT DOCUMENTS 4,044,945 A * 8/1977 Kohlstette
4,164,317 A * 8/1979 Nelson
4,375,870 A * 3/1983 Bodelson
4,432,748 A * 2/1984 Novoselac et al.
6,390,964 B1 * 5/2002 Mackel

FOREIGN PATENT DOCUMENTS

| | | | |
|---|---|---|---|
| CH | 523096 | * | 7/1972 |
| DE | 617703 | * | 8/1935 |
| DE | 1057535 | * | 5/1959 |
| DE | 2808677 | * | 9/1978 |
| DE | 2822478 A1 | | 12/1978 |
| DE | 3141356 | * | 4/1983 |
| DE | 3607526 | * | 9/1987 |
| DE | 3821486 | * | 12/1989 |
| FR | 1598924 | * | 8/1970 |

OTHER PUBLICATIONS

Hanno–R. Lehmann, Karl–Heinz Zettier, *Whey Processing Lines*, Technical–scientific documentation No. 6, Third revised edition 1988, Published by Westfalia Separator AG.

* cited by examiner

*Primary Examiner*—Charles E. Cooley
(74) *Attorney, Agent, or Firm*—Barnes & Thorngurg

(57) ABSTRACT

The present invention relates to a centrifuge including a centrifugal drum, a supply pipe, a distributor, a displacement sleeve valve having an opening chamber and a closing chamber, a supply duct, a control gas feed in the distributor and a closing spring biasing the sleeve valve towards a closed condition during a pressure buildup in the opening chamber. The present invention also relates to a method of operating the centrifuge using a control gas to operate the sleeve valve and cleaning of control fluid paths by guiding a flushing fluid or flushing gas through the control fluid paths.

9 Claims, 1 Drawing Sheet

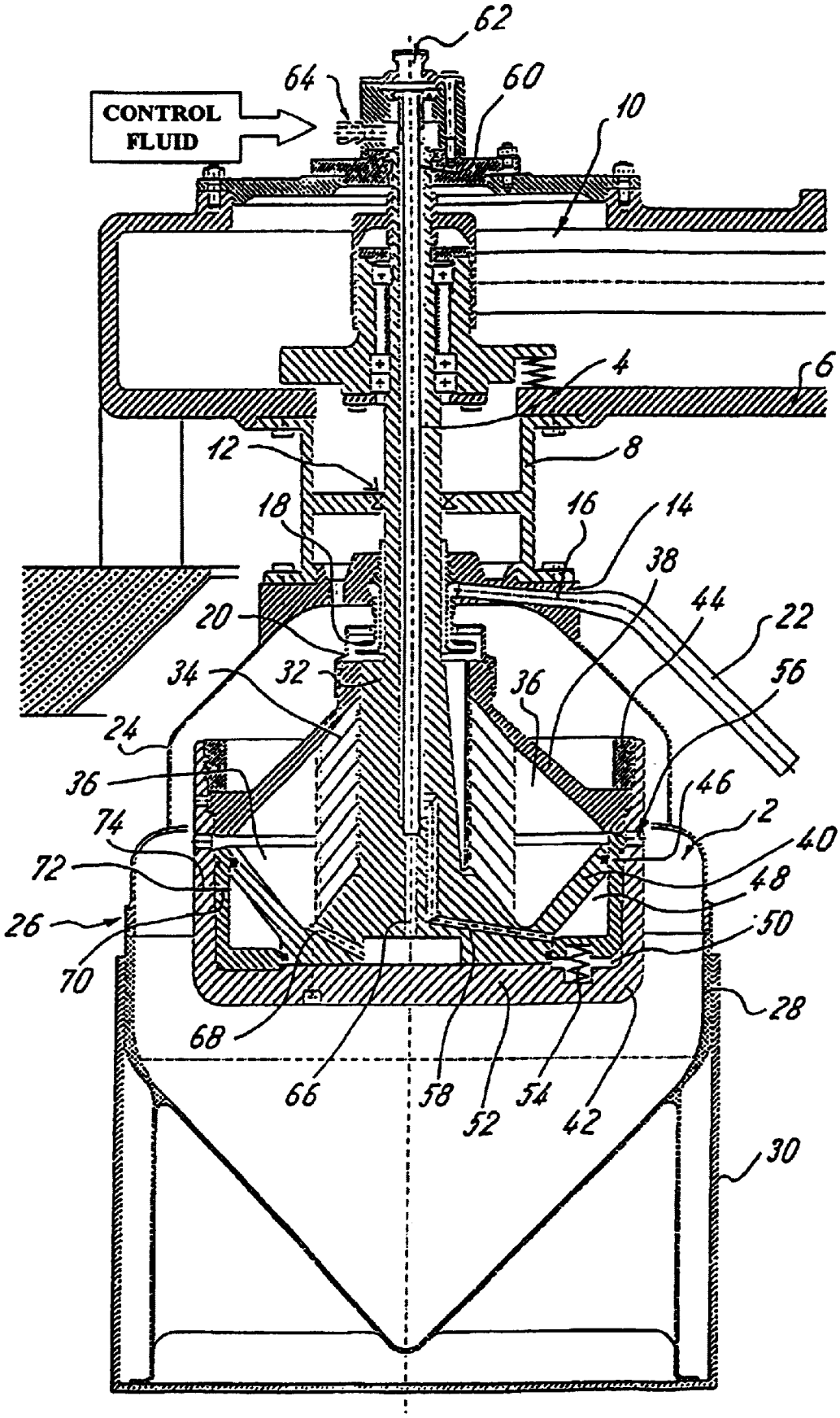
CONTROL FLUID
62
64
60
10
4
6
12
8
18
16
14
38
44
22
20
34
32
36
56
24
36
46
2
74
40
72
48
26
50
70
28
68
66
58
54
52
42
30

CENTRIFUGE HAVING A GASEOUS MEDIUM AS A CONTROL FLUID AND METHOD OF OPERATING

BACKGROUND AND SUMMARY OF THE INVENTION

The invention relates to a centrifuge which has the following: A centrifugal drum, a supply pipe which leads into the centrifugal drum for introducing a material for the centrifugal process into the centrifugal drum, and a supply duct for supplying a control fluid into an opening and/or closing section of the centrifugal drum. The invention also relates to a method of operating a centrifuge according to the invention.

A centrifuge of this type is known from German Patent Document DE 28 22 478. The centrifuge illustrated in that document has a centrifugal drum with a sleeve valve to which a chamber is assigned which is connected by ducts in a spindle with a hydraulic system. The introduction of the product takes place from above by way of a central supply pipe. The spindle is situated on the underside of the centrifugal drum. Although this construction has been found to be successful per se, it reaches its limits when, for hygiene reasons, the product area is to be situated separately from the driving area of the centrifuge and the control elements of the drive as well as the control elements of the control fluid supply outside the drum (valves, etc.).

From German Patent Document DE-A-2808677, the use of a gaseous medium as control fluid is known, the supply duct being concentrically to the supply pipe for the process material.

A centrifuge of the above-mentioned type is known from U.S. Pat. No. 4,044,945. However, this construction does not ensure that, for reasons of hygiene, the product area is situated separate from the driving area of the centrifuge and the control elements of the drive as well as the control elements of the control fluid supply outside the drum (valves, etc.).

The object of the invention consists of further developing the centrifuge of the above-mentioned type such that a gaseous medium can be used as a control fluid in order to permit an uncomplicated handling and the use under sterile conditions.

The invention achieves this goal because the control fluid supply and the material supply are thus jointly guided into the centrifugal drum and preferably extend also directly side-by-side, a constructively separate supply of the control fluid can be avoided.

The invention is particularly suitable for a centrifuge wherein the centrifugal drum hangs on a centrifuge frame, the supply pipe for the process material and the supply duct for the control fluid extend jointly from above into the centrifugal drum. In the case of centrifuges with hanging centrifugal drums, a separate feeding of the control fluid from below into the drum is not practical because it may be necessary to collect the solids separated in the separation process below the drum in a sterile container. This is clearly simplified by the control fluid supply "from above".

A double-walled pipe has the advantage of a particularly space-saving housing of the control fluid supply and of the process material supply.

In this case, the control fluid supply is used for operating a displaceable sleeve valve for opening and closing discharge openings for solids in the centrifugal drum. In this case, an opening chamber and a closing chamber adjoin the sleeve valve. The sleeve valve is moved by the admission of pressure by means of the control fluid, in which case it is also possible to hold the sleeve valve in a spring-tensioned manner in one of its operating positions and move it into the respective other operating position by a pressure buildup in the corresponding control chamber.

In this case, a gaseous medium, preferably sterile air, is used as the control fluid, which can be handled in an uncomplicated manner and is well suited for a use as a control medium under sterile conditions, because, also in the event of a direct contact with the process material, a contamination of the latter will be prevented.

Other objects, aspects and novel features of the present invention will become apparent from the following detailed description of the invention when considered in conjunction with the accompanying drawings.

BRIEF DESCRIPTION OF THE DRAWINGS

The FIGURE is a sectional view of a centrifuge according to the invention with a sleeve valve which is illustrated in its opening position in the left section of the drawing and in its closing position in the right section of the drawing.

DETAILED DESCRIPTION OF THE PREFERRED EMBODIMENT

It should be noted that terms such as "bottom" and "top" relate to a centrifuge in the case of which the supply pipe extends essentially perpendicularly and the centrifugal drum hangs on the bottom on a centrifuge frame. These terms should definitely not be considered to be limiting.

The FIGURE shows a centrifuge which is constructed as a separator and which, in a manner known per se, has a centrifugal drum 2 adjoined toward the bottom for separating a process material into different components. The process material or the process liquid are guided in the downward direction through a central supply pipe 4 into the centrifugal drum 2.

The centrifugal drum 2 is suspended on a centrifuge frame 6 with a lower frame attachment 8. The driving section 10 of the centrifuge—which can be constructed in a manner known per se and will therefore not be shown here in detail—is arranged above the centrifugal drum 2 in the and/or at the centrifuge frame 6 and is sealed off from the centrifugal drum 2 by a sealing section 12—which is also not shown in detail—in the frame attachment 8. The centrifugal drum 2 is therefore clearly constructively separated from its driving section as well as the control elements of the driving section.

A container lid 14 is flanged to the lower end of the frame attachment 8, which container lid 14 is penetrated in the center by the supply pipe 4. The container lid 14 here has an essentially radially constructed bore 16 which is used as a drainage duct for a liquid phase discharged, by a rotary-cut disk 18, from a rotary-cut chamber 20 from the centrifugal drum 2. The bore 16 leads into a drainage pipe 22.

An upper container jacket 24, which surrounds the centrifugal drum 2 in its upper area, is molded to the container lid 14. This container jacket 24 is used as an upper end of a container 26, which is conical here, for receiving solids. The lower section 28 of the container is removable from the centrifuge in the downward direction and stands in a container frame 30.

The actual centrifugal drum 2 has a distributor 32 which surrounds the supply pipe 4 and which has a plate stack 34 joined on the outside to the distributor 32. The plate stack 34 is situated in a centrifugal space 36 which conically narrows, in this case, in the upward and downward direction. The centrifugal space 36 is limited in the upward direction by a conically shaped drum lid 38 and in the downward direction by a centrifugal space bottom 40 molded at the bottom onto the distributor 32. The drum lid 38 is inserted into a drum bottom part 42 and, in the drum bottom part 42, is screwed to a closing ring 44.

Between the centrifugal space bottom 40 and the lower housing wall of the drum bottom part 42, a displaceably guided, ring-shaped sleeve valve 46 is arranged which has a wall cross-section which is essentially L-shaped in this case and which is adjoined upward by an opening chamber 48 and downward by a closing chamber 50. The lower wall of the drum bottom part 42 is used as the lower closing chamber bottom 52. Between the lower wall of the sleeve valve 46 and the closing chamber bottom 52—this in the closing chamber 50—are closing springs 54 which hold the sleeve valve 46 in the closing position closing off the discharge openings 56 for the solids in the exterior jacket of the drum bottom part 42 (right portion of FIG. 1).

The opening chamber 48 is constructed between the sleeve valve 46 and the lower wall of the distributor 32 or the centrifugal space bottom 40. The control fluid supply into the opening chamber 48 takes place by way of a control fluid feed 58 in the distributor 32.

The control fluid feed 58 leads into a ring-shaped supply duct 60, which surrounds the supply pipe 4, between the interior wall of the distributor 32 and the supply pipe 4 inserted into the distributor 32. In this case, the interior wall of the distributor 32 and the wall of the supply pipe 4 form a type of "pipe with a double wall", the actual supply duct 60 for the control fluid concentrically surrounding the supply pipe 4 for the process material.

In the FIGURE, the distributor 32 of the centrifuge extends through the latter in one piece from the upper end area of the centrifuge frame 6 to the closing chamber bottom 52. However, in practice, this element is preferably assembled of several parts.

Above the upper end area of the centrifuge frame 6, an axial connection 62 permits the feeding of the process material into the supply pipe 4. A connection 64, which extends radially to the outside here, is used for feeding the control fluid—particularly the supplying of sterile control air—into the supply duct 60 surrounding the supply pipe.

The operation of the centrifuge of the FIGURE is as follows:

The feeding of the process material takes place through the connection 62 and the supply pipe 4 as well as through an axial bore 66 of the distributor 32 and a bore 68 in the centrifugal space bottom 40 into the centrifugal space 36. Solids are discharged from the centrifugal space 36 through the openings 56; liquid phases are discharged through the rotary-cut chamber 20 with the rotary-cut disk 18.

The control air is fed as the control fluid through the connection 64 into the supply duct 60 concentrically surrounding the supply pipe 4. From there, the control air flows into the control fluid feed 58 and from there into the opening chamber 48. As a result, when the pressure buildup in the opening chamber 48 is sufficiently large, the sleeve valve 46 is pressed downward against the spring force of the closing springs 54, which opens up the outlet openings 56 for the solids (left section of FIG. 1). In contrast, a lowering of the pressure in the opening chamber 48, because of the spring force of the closing springs 54, results in a displacement of the sleeve piston 46 in the upward direction, which closes the outlet openings 56 for the solids again.

The sleeve valve 46 and the exterior wall of the centrifugal drum 2 have passage bores 70, 72, which are in a mutual operating connection in one of the working positions of the sleeve valve and can be closed by means of a stopper 74, after the removal of the stopper 74. A simple possibility is obtained for cleaning the control fluid paths (40, 58, 48) as well as additional centrifugal elements, for example, by means of a flushing liquid or a flushing gas, for example, for a particularly uncomplicated implementation of a CP cleaning in place) process.

What is claimed is:

1. A centrifuge comprising:

a centrifugal drum;

a supply pipe which leads into the centrifugal drum for introducing a material for the centrifugal process through a distributor into the centrifugal drum;

a displaceable sleeve valve in the centrifugal drum and having an opening chamber and a closing chamber for opening and closing discharge openings for solids in the centrifugal drum;

a supply duct concentrically surrounding the supply pipe for the process material;

a control gas feed in the distributor connecting the supply duct to the opening chamber such that the sleeve valve can be operated by pressure buildup or pressure reduction of a control gas; and a closing spring biasing the sleeve valve towards a closed condition during the pressure buildup in the opening chamber.

2. The centrifuge according to claim 1, wherein, the centrifugal drum hangs on a centrifuge frame; and the supply pipe for the process material and the supply duct for the control gas jointly extend from above into the centrifugal drum.

3. The centrifuge according to claim 1, wherein the sleeve valve and an outer wall of the centrifugal drum have passage bores which are in a mutual operating connection in one of the working positions of the sleeve valve and can be closed by a stopper.

4. The centrifuge according to claim 3, wherein the passage bores are connected to the opening chamber so that a cleaning of the supply duct, the control gas feed, and the opening chamber can be flushed by a flushing gas or a flushing liquid with the stoppers removed.

5. The centrifuge according to claim 4, wherein the control gas is sterile air.

6. The centrifuge according to claim 1, wherein above an upper end area of a centrifuge frame, a connection is provided for feeding the process material into the supply pipe and a connection is provided for feeding the control gas into the supply duct.

7. A method of operating a centrifuge according to claim 1, comprising:

using a control gas to operate the sleeve valve; and cleaning of control fluid paths, which include the supply duct, the control gas feed and the opening chamber and/or of additional centrifuge elements of said centrifuge, by guiding a flushing liquid or flushing gas through the control fluid paths.

8. A method of operating a centrifuge of claim 1 comprising using a control gas to control the sleeve valve.

9. The method according to claim 8, wherein the control gas is sterile air.

* * * * *